United States Patent [19]

Patil et al.

[11] 4,144,379

[45] Mar. 13, 1979

[54] DRAWING QUALITY HOT-DIP COATED STEEL STRIP

[75] Inventors: Ram S. Patil, Munster; John N. Polakowski, Chesterton, both of Ind.

[73] Assignee: Inland Steel Company, Chicago, Ill.

[21] Appl. No.: 830,032

[22] Filed: Sep. 2, 1977

[51] Int. Cl.[2] ..... B32B 15/18; B32B 15/20

[52] U.S. Cl. ..... 428/653; 148/12 C; 148/12 D; 148/36; 427/320; 427/321; 428/659

[58] Field of Search ..... 148/12 C, 12 D, 36; 427/320, 321; 428/653, 659

[56] References Cited

U.S. PATENT DOCUMENTS

| | | | |
|---|---|---|---|
| 3,560,270 | 2/1971 | Reinbold et al. | 148/12 C |
| 3,701,694 | 10/1972 | Osuku et al. | 148/12 F |
| 3,716,420 | 2/1973 | Matsudo et al. | 148/12 C |
| 3,765,874 | 10/1973 | Elias et al. | 148/12 C |
| 3,821,031 | 6/1974 | Kubotera et al. | 148/12 C |
| 3,843,417 | 10/1974 | Ohbu et al. | 148/12 D |
| 3,897,279 | 7/1975 | Shaughnessy et al. | 148/36 |
| 3,988,174 | 10/1976 | Kawano | 148/36 |
| 4,001,052 | 1/1977 | Nakazato et al. | 148/36 |
| 4,008,103 | 2/1977 | Miyoshi et al. | 148/12 F |
| 4,067,754 | 1/1978 | Elias et al. | 148/12 F |

FOREIGN PATENT DOCUMENTS

| | | | |
|---|---|---|---|
| 465804 | 6/1950 | Canada | 148/12 C |
| 50-67712 | 6/1975 | Japan | 148/12 D |
| 1168636 | 10/1969 | United Kingdom | 148/12 C |

*Primary Examiner*—Arthur J. Steiner

*Attorney, Agent, or Firm*—Merriam, Marshall & Bicknell

[57] ABSTRACT

A drawing quality hot-dip coated low carbon aluminum killed steel strip produced by conventional steel strip forming and continuous hot-dip coating procedures wherein the hot rolled coiling temperature is maintained within a temperature range of 1250° F. - 1300° F. and the cold rolled steel strip is continuously heat treated on a Sendzimir-type continuous hot-dip coating line at a temperature of between 1850° F. and 1950° F. before cooling the strip to about the temperature of the hot-dip coating bath and immersing the strip in a hot-dip galvanizing or aluminum coating bath followed by conventional annealing. The microstructure of the drawing quality hot-dip coated steel strip is characterized by spaced islands formed of fine pearlite and fine ferrite having a grain size of about ASTM 9-10 surrounded by areas of large ferrite grains having the grain size of about ASTM 7.5-8. A typical hot-dip coated drawing quality steel strip produced by the process has a Rockwell B hardness of about 47, an average lower yield strength of about 32 KSI and an average ultimate tensile strength of 50 KSI and an average total elongation percent in two inches of about 40 percent.

4 Claims, 2 Drawing Figures

DRAWING QUALITY HOT-DIP COATED STEEL STRIP

This invention relates generally to a low carbon killed hot-dip coated steel strip having improved drawing quality and more particularly to a drawing quality plain low carbon aluminum-killed hot-dip galvanized or aluminum coated steel strip and to a method of producing such a drawing quality hot-dip coated steel strip material.

An ever increasing number of steel parts which must be drawn in a die or similarly formed during fabrication and which require protection against corrosion are being made from galvanizing-type steel sheet material having a hot-dip protective coating of zinc, aluminum and various alloy coatings. The breakage rate due to metallurgical reasons of conventional galvanized steel sheet material when subjected to considerable deformation during fabrication is relatively high. For example, wheelhouse panels formed from conventional galvanized steel sheet material which require about a 13.5 inch draw made in a single die stroke have about a six percent breakage rate.

While considerable effort has heretofore been made to improve the formability and the adherence of hot-dip galvanized coatings, relatively little attention has been given to improving the formability or drawing properties of plain carbon galvanizing steel sheet material per se.

It is therefore an object of the present invention to provide a drawing quality plain low carbon killed steel strip hot-dip coated with a protective metallic coating and having drawing properties which are substantially improved over conventional hot-dip coated sheet material.

It is another object of the present invention to provide a plain low carbon aluminum killed galvanized or aluminized steel sheet having improved formability and drawing properties which does not require adding to the steel any alloying element not normally present in a plain low carbon killed steel.

It is a further object of the present invention to provide an improved processs of producing a plain low carbon killed steel strip hot-dip coated with a protective metallic coating and havng improved drawing properties which does not require incorporating in the steel an alloying element which is not normally present in a plain low carbon killed steel.

Other objects of the present invention will be apparent to one skilled in the hot-dip coating art from the detailed description and claims to follow when read in conjunction with the accompanying drawing, wherein:

Figure 1:
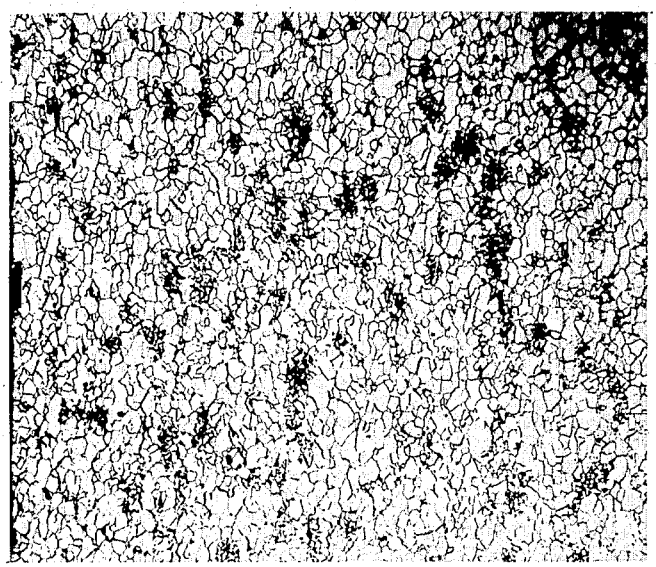
FIG. 1 is a photomicrograph showing the microstructure of a hot-dip galvanized low carbon aluminum killed steel sheet prepared in accordance with the present invention which has improved drawing quality.

Steel used for producing continuous hot-dip coated steel strip material is subjected to a wide range of heating and cooling conditions during the production and hot-dip coating thereof from the hot rolling mill through the continuous hot-dip coating line. As a result of the varying conditions to which the steel is normally subjected, the microstructure produced in a strip of galvanizing steel, for example, particularly a low carbon aluminum-killed steel, is such that the drawing properties of the steel strip per se have heretofore been relatively limited. Thus, the in-line heat treatment to which a steel strip is normally subjected during conventional hot-dip continuous galvanizing or aluminizing results in a relatively hard sheet of steel having at best only limited ductility and formability after the continuous hot-dip galvanizing thereof.

It has now been discovered that a continuous hot-dip galvanizing-type steel strip having significantly improved drawability can be provided by effecting control of the processing steps of producing and hot-dip coating a plain low-carbon killed steel strip beginning with the hot-mill rolling and coiling of the steel and continuing through the steps of cold rolling, in-line heat treating which precedes continuous hot-dip coating and preferably through the soaking or annealing of the coiled hot-dip coated steel sheet material.

In order to provide a strip of galvanized or aluminized plain low carbon aluminum killed steel sheet material having improved drawing quality where the strip is hot-dip galvanized or aluminized by an in-line continuous process of the Sendzimirtype, the steel, after being hot-mill rolled within the normal finishing temperature range of about 1500–1650° F. and preferably at an average finishing temperataure of about 1590° F., is hot-roll coiled at a higher than normal temperature range and within the limited temperature range of about 1250° F. to 1300° F. and preferably at an average temperature of about 1275° F., followed by conventional pickling to remove surface oxides which interfere with efficient cold reduction, as by contacting with dilute hydrochloric acid. The steel strip is then cold reduced to effect a reduction in thickness, preferably greater than 50 % of the thickness of the strip in the hot-mill rolled coiled form, so as to provide a steel strip having a thickness suitable for continuous hot-dip galvanizing or aluminized. Thereafter, the cold reduced steel strip is processed on a conventional continuous hot-dip galvanizing or aluminizing line in which the steel sheet is cleaned chemically or, if preferred, the strip can be cleaned by exposing the strip to a controlled oxidizing flame, as by passing the steel strip through an open flame oxidizing furnace which burns off any oil or grease on the surface of the strip and provides a uniform light oxide film on the surface of the steel. The strip should then be continuously passed through an "in-line" heat treating zone (See U.S. Pat. No. 2,197,622) having a reducing atmosphere, such as an atmosphere of cracked ammonia or HN gas, which reduces oxides on the surface of the steel to provide a clean metallic surface receptive to molten aluminum or to the galvanizing spelter which preferably contains a small amount of aluminum (i.e., about 0.18 wt. %) and/or a small amount of one or more other alloying elements which improve the coating quality. while the steel strip is travelling at a line speed of 180 fpm through the in-line heat treating zone the steel must be heated to a temperature of at least 1850° F. but not substantially above 1950° F., and preferably at an average temperature of about 1900° F., in order to insure that the coated steel sheet or strip has the desired improved drawing quality. The temperature of the strip is allowed to remain at the elevated temperature of between 1850° F. and about 1950° F., for only a brief period (i.e., about 30–45 seconds) and then is cooled to about the temperature of the hot-dip coating bath (i.e., about 850° F. for galvanizing) before immersing the strip in the hot-dip coating bath.

After withdrawing the strip from the hot-dip coating bath, and coiling the coated strip in a conventional manner, the coated steel strip in coil form is subjected to conventional batch annealing at a temperature of between 500° F. and 570° F. for a period of about 20 hours. The actual soak time during the final batch anneal will depend on the weight of the anneal charge. An equivalent continuous annealing treatment can be used in place of the batch anneal, if desired.

A strip of plain low carbon aluminum killed steel (hereinafter designated as Strip A) and having the following chemical analysis: 0.03–0.04% Carbon, 0.33–0.38% Manganese, 0.007–0.009% Phosphorus, 0.016–0.024% Sulfur, 0.010—0.010% Silicon, 0.030–0.050% Aluminum, with the balance being essentially Iron, was processed in accordance with the above-described procedure, wherein the strip was maintained during hot-mill rolling at an average finishing temperature of 1590° F. and at an average coiling temperature of 1275° F. The hot mill rolled strip which had a thickness of 0.115 inches after coiling was cold rolled to a final thickness of 0.047" suitable for continuous in-line hot-dip galvanizing. During the heat treating step while the strip was travelling at a rate of 180 fpm through a hot-dip galvanizing line and prior to immersion in the hot-dip coating bath the strip was heat treated in the reducing atmosphere to an average temperature of about 1900° F. for about 35 seconds.

A second plain low carbon aluminum killed steel strip (hereinafter designated Strip B) and having substantially the same chemical analysis as Strip A was processed generally in the above described manner, but with the strip being hot-mill rolled and coiled in accordance with conventional operating conditions during which the strip had an average finishing temperature of 1600° F. and an average coiling temperature of 1180° F. The Strip B having the same dimensions as Strip A was given a conventional heat treatment on the same continuous hot-dip galvanizing line as Strip A. While travelling at a line speed of 180 fpm, the strip was heat treated in the reducing atmosphere to an average temperature of 1800° F. for about 35 seconds.

The steel Strips A and B prepared in the above described manner had the following mechanical properties:

| Product | Hardness Rb Scale* | Lower Yield Strength KSI (Average) | Ultimate Tensile Strength KSI (Average) | Total Elongation % in 2" (Average) |
|---|---|---|---|---|
| Strip A | 47 | 32.0 | 49.5 | 40.00 |
| Strip B | 53 | 37.5 | 50.0 | 38.0 |

*Rockwell B Hardness Scale

Photomicrographs of Strip A and Strip B at 100× were prepared from test samples of the full-width as-coated steel strips taken at a mill rewind unit after the post galvanizing anneal. Microspecimens from the sheet quarter width position were bolted together and polished according to established micro preparation techniques. These include emery papers of various roughness followed by diamond paste polishing and concluded with final grinding with alumina powder. The specimens were then etched in a picral etchant to reveal carbide morphology. This was followed by etching in a 3 percent nital solution to reveal ferrite grain structure.

The photomicrograph of Strip A shown in FIG. 1 of the drawing is representative of a low carbon aluminum killed hot-dip galvanized steel strip of the present invention which has superior softness and ductility properties. The Strip A has a microstructure characterized by a small volume fraction of randomly spaced dark patches or islands formed of fine pearlite and fine ferrite grains having a grain size rated as ASTM 9–10 and with the areas surrounding the islands containing large ferrite grains of a size rated at ASTM 7.5–8 (the underlined numeral designating more nearly the average grain size of the structure).

Figure 2:
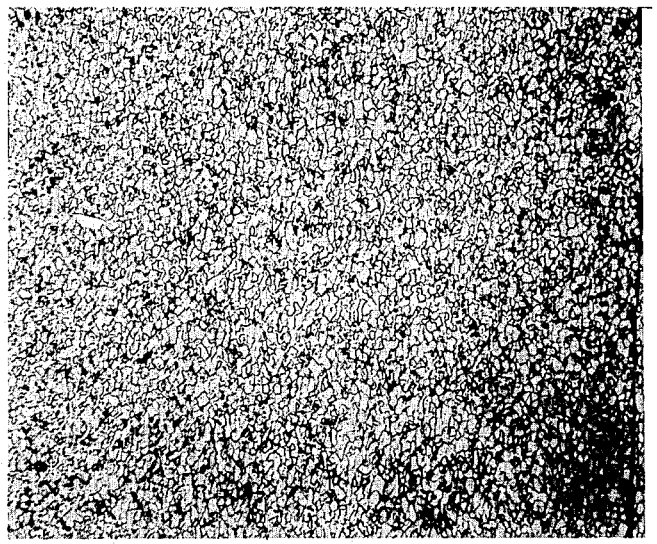
FIG. 2 is a photomicrograph showing the microstructure of a conventional drawing quality hot-dip galvanized low carbon aluminum killed steel sheet.

The photomicrograph of Strip B which is shown in FIG. 2 of the drawing is representative of a conventional drawing quality hot-dip galvanized steel strip. The Strip B has a ferritic grain size rated as ASTM 9–10 with the pearlite being randomly but relatively evenly distributed throughout the ferritic grains and having a grain size rated at ASTM 13–15.

In applying the present invention to provide drawing quality hot-dip aluminum coated steel a plain low carbon aluminum killed steel strip having a chemical analysis substantially the same as Strip A was hot rolled and coiled in the same manner as Strip A and thereafter cold rolled to a final thickness of 0.047 inches. The steel strip was then continuously hot-dip aluminum coated using a continuous Sendzimir-type in-line heat treatment, as in hot-dip galvanized Strip A, during which the strip was heated to between 1850° F. and 1950° F. with an average temperature of 1900° F. for about 30 seconds immediately before hot-dip aluminum coating and allowed to cool in a protective non-oxidizing atmosphere to about the temperature of the hot-dip aluminum coating bath which can range between 1250° F. and 1350° F. and preferably at 1300° F. The aluminum coated strip after passing through the hot-dip aluminum coated bath and between suitable gas jet coating thickness control means was coiled and batch annealed, as with Strip A. The resulting aluminum coated strip exhibited excellent drawing properties which were substantially the same as in Strip A.

While the hot-dip coated steel sheet material produced in accordance with the present invention exhibits substantially improved drawability and has a coarse ferrite grain structure with isolated carbides as a result of processing the steel at a higher than normal hot mill coiling temperature and heat treating the steel strip to a temperature of at least 1850° F. in a non-oxidizing or reducing atmosphere during in-line heat treatment immediately prior to continuous hot-dip coating, the precise mechanism which produces the improved drawability is not known but is thought to be the result of the higher than normal hot mill coiling temperature causing the formation of a larger than normal aluminum nitride precipitate and larger carbide precipitates which are spaced a greater distance than normal. And, during the in-line continuous heat treatment immediately prior to hot-dip coating, the carbides are thought to be dissolve to form austenite when the steel is heated during the in-line heat treatment to a higher than normal temperature of at least 1850° but not substantially above 1950° F. Due to the short time the steel is allowed to remain at a temperature of at least 1850°, two distinct types of austenite are thought to be formed; one being carbon-rich austenite formed from the large carbide precipitates and the other being carbon-lean austenite formed in the areas between the large carbide precipitates. The aluminum nitride precipitates which normally pin the austenite grain boundaries and inhibit secondary recrystallization of austenite are thought also to be dissolved in the austenite when the steel is heated to a temperature of between 1850° and 1950° F. which allows the austenite grains to grow larger than they normally would, if the steel were heated to a temperature of only 1600°F. to 1800° F., as in conventional continuous in-line heat-treatment prior to hot-dip galvanizing or aluminizing. When the steel is cooled rapidly from a temperature of 1850° F.–1950° F. down to about the hot-dip coating bath temperature (i.e., about 850° F. when galvanizing), the carbon-rich austenite is transformed into spaced fine pearlite islands and fine ferrite having a crystal grain size of about ASTM 9–10, while the surrounding areas of low-carbon austenite are transformed on cooling to large ferrite grains having a grain size of about ASTM 7.5–8 with isolated small grain boundary cementite (See FIG. 1).

The annealing treatment preferably used following the hot-dip coating, such as the batch soaking of the hot-dip coated steel coil at a temperature of 500° F.–570° F. for about 20 hours, effects removal of excess carbon entrapped in the ferrite solid solution formed when the steel strip is cooled rapidly from the heat treating temperature down to the temperature of the hot-dip coating bath and softens the steel. It is desirable to include a batch or continuous final annealing treatment of the coated material in order to minimize the effect of age hardening on the steel and provide the hot-dip coated material with optimum mechanical properties.

The terms "galvanizing steel" or "galvanizing-type steel" as used herein refer to steel having a composition conventionally used in the continuous galvanizing and aluminizing of sheets or strips of steel and commonly designated as mild steel or plain carbon steel with the steel having a maximum carbon content of about 0.15 wt. % and preferably a carbon content less than 0.1 wt. % carbon. Generally, but not necessarily, the steel will contain a small amount of aluminum as a result of adding aluminum to remove any oxygen remaining in the steel (i.e., aluminum killed steel). The steel does not require the addition thereto of any other alloying element not normally present in a plain low carbon steel in order to provide the improved drawing properties.

The term "hot-dip coating" as used in the foregoing description and claims is intended to designate a hot-dip galvanized or aluminized coating comprised mainly of either zinc or aluminum, respectively, and various combinations thereof along with minor amounts of other alloying elements conventionally used in zinc or aluminum hot-dip coatings.

The terms "galvanized" and "galvanizing" as used in the foregoing description and in the claims designate any zinc based coating applied to the surface of a steel sheet and include zinc alloy of aluminum, magnesium, lead, antimony, tin, and the like metals which can be used to improve the zinc coating or to impart special properties thereto.

While the invention as applied to a hot-dip coated steel strip and method of producing a hot-dip coated steel strip having improved drawing qualities has been described with reference to a Sendzimir-type continuous hot-dip coating line, it should be understood that the protective galvanizing coating can be applied by other hot-dip coating procedures provided the steel strip prior to hot-dip coating is subjected to the same or equivalent heat treating conditions disclosed herein.

We claim:

1. A drawing quality hot-dip coated steel sheet consisting essentially of a cold rolled sheet of a low carbon aluminum killed steel free of alloying elements not normally present in a low carbon aluminum killed steel and having a hot-dip coating of a metal which provides protection against corrosion, said steel after hot-dip coating having a microstructure as in FIG. 1, and said microstructure consisting essentially of a small volume fraction of spaced islands of fine ferrite having a grain size of about 9–10 interspersed with fine pearlite and the balance of large ferrite grains having a grain size of about ASTM 7.5–8 with small grain boundary cementite.

2. A hot-dip coated steel strip as in claim 1, wherein said hot-dip coated steel strip has a Rockwell B hardness of about 47, an average lower yield strength of about 32 KSI, an average ultimate tensile strength of about 50 KSI, and an average total elongation percent in two inches of about 40 percent.

3. A steel strip as in claim 1, wherein said hot-dip coating is a galvanized coating.

4. A steel strip as in claim 1, wherein said hot-dip coating is an aluminum coating.

* * * * *